US009725849B2

(12) United States Patent
Nuopponen et al.

(10) Patent No.: US 9,725,849 B2
(45) Date of Patent: Aug. 8, 2017

(54) METHOD FOR PRETREATING CELLULOSE PULP

(71) Applicant: UPM-Kymmene Corporation, Helsinki (FI)

(72) Inventors: Markus Nuopponen, Helsinki (FI); Monika Osterberg, Espoo (FI); Janne Laine, Helsinki (FI); Jaakko Pere, Vtt (FI)

(73) Assignee: UPM-Kymmene Corporation, Helsinki (FI)

( * ) Notice: Subject to any disclaimer, the term of this patent is extended or adjusted under 35 U.S.C. 154(b) by 0 days.

(21) Appl. No.: 15/065,203

(22) Filed: Mar. 9, 2016

(65) Prior Publication Data

US 2016/0186376 A1 Jun. 30, 2016

Related U.S. Application Data

(63) Continuation of application No. 14/376,875, filed as application No. PCT/FI2013/050150 on Feb. 11, 2013, now Pat. No. 9,315,942.

(30) Foreign Application Priority Data

Feb. 10, 2012 (FI) ..... 20125146

(51) Int. Cl.

| | |
|---|---|
| ***D21B 1/06*** | (2006.01) |
| ***D21C 9/00*** | (2006.01) |
| ***D21H 11/16*** | (2006.01) |
| ***D21H 11/18*** | (2006.01) |
| ***D21B 1/16*** | (2006.01) |
| ***D21H 11/10*** | (2006.01) |
| ***D21H 17/65*** | (2006.01) |
| ***D21H 17/66*** | (2006.01) |
| ***D21C 3/04*** | (2006.01) |
| ***D21C 3/26*** | (2006.01) |
| ***D21C 9/02*** | (2006.01) |
| ***D21C 9/18*** | (2006.01) |

(52) U.S. Cl.

CPC ..... *D21B 1/063* (2013.01); *D21B 1/16* (2013.01); *D21C 3/04* (2013.01); *D21C 3/26* (2013.01); *D21C 9/007* (2013.01); *D21C 9/02* (2013.01); *D21C 9/18* (2013.01); *D21H 11/10* (2013.01); *D21H 11/16* (2013.01); *D21H 11/18* (2013.01); *D21H 17/65* (2013.01); *D21H 17/66* (2013.01)

(58) Field of Classification Search

CPC ... D21B 1/06; D21C 9/18; D21C 9/02; D21C 3/04

USPC ..... 162/181.2

See application file for complete search history.

(56) References Cited

U.S. PATENT DOCUMENTS

| | | | |
|---|---|---|---|
| 8,911,591 | B2 | 12/2014 | Ankerfors |
| 2005/0272836 | A1 | 12/2005 | Yaginuma |
| 2012/0000392 | A1 | 1/2012 | Mukai |
| 2014/0323714 | A1 | 10/2014 | Sivonen |

FOREIGN PATENT DOCUMENTS

| | | |
|---|---|---|
| EP | 2395027 | 12/2011 |
| JP | H 0610288 A | 1/1994 |
| WO | WO 2007/091942 A1 | 8/2007 |
| WO | WO 2008/126106 | 10/2008 |
| WO | WO 2009/126106 | 10/2009 |
| WO | WO 2010/092239 | 8/2010 |
| WO | WO 2010/125247 | 11/2010 |
| WO | WO 2010/131088 | 11/2010 |
| WO | WO 2011/064441 | 6/2011 |
| WO | WO 2013/117823 | 8/2013 |

OTHER PUBLICATIONS

International Search Report dated Jun. 10, 2013, corresponding to PCT/FI2013/050150.

Finnish Search Report dated Aug. 7, 2012, corresponding to the Foreign Priority Application No. 20125146.

L Wagberg, et al.; "The Build-Up of Polyelectrolyte Multilayers of Microbibrillated Cellulose and Cationic Langmuir"; 2008; vol. 24; pp. 784-795.

C. Aulin, et al.; Buildup of Polyelectrolyte Multilayers of Polyethyleneimine and Microfibrillated Cellulose Studies by in Situ Dual-Polarization Interferometry and Quartz Crystal Microbalance with Dissipation; Langmuir, 2008, vol. 24, pp. 2509-2518.

C. Aulin, et al.; "Self-Organized Films from Cellulose i Nanofibrils Using the Layer-by-Layer Technique"; 2010, vol. 2010; pp. 872-882.

Horvath et al., "On the Indirect Polyelectrolyte Titration of Cellulosic Fibers. Conditions for Charge Stoichiometry and Comparison with ESCA", Langmuir, 2006, vol. 22, pp. 824-830.

Solala et al., "Mechanoradical formation and its effects on birch kraft pulp during the preparation of nanofibrillated cellulose with Masuko refining", Holzforschung, 2012, vol. 66, Issue 4, pp. 477-483.

Finnish Office Action dated Oct. 2, 2014, from corresponding FI application.

International Written Opinion, PCT/FI2013/050150, 4 pages, date of mailing Jun. 10, 2013.

Scallan et al., "The Effect of Cations on Pulp and Paper Properties", Pulp and Paper Research Institute of Canada, Svensk Papperstidning 2 (1979) (8 pages).

Swerin et al., "Deswelling of Hardwood Kraft Pulp Fibers by Cationic Polymers", Nordic Pulp and Paper Research Journal No. 411990 (9 pages).

Nakagaito et al., "The Effect of Morphological Changes from Pulp Fiber Towards Nano-Scale Fibrillated Cellulose on the Mechanical Properties of High-Strength Plant Fiber Based Composites", Applied Physics A, 78 (2004) (6 pages).

Henriksson et al., "An Environmentally Friendly Method for Enzyme-Assisted Preparation of Microfibrillated Cellulose (MFC) Nanofibers", European Polymer Journal 43 (2007) (8 pages).

*Primary Examiner* — Mark Halpern

(74) *Attorney, Agent, or Firm* — Nixon Peabody LLP

(57) ABSTRACT

The invention relates to pretreating of native cellulose pulp in the manufacture of nanofibrillated cellulose, and to a nanofibrillated cellulose product obtainable by the method.

11 Claims, 2 Drawing Sheets

METHOD FOR PRETREATING CELLULOSE PULP

REFERENCE TO RELATED APPLICATIONS

This application is a continuation of U.S. patent application Ser. No. 14/376,875, filed Aug. 6, 2014, which is a U.S. National Stage of International Application No. PCT/FI2013/050150, which claims the benefit of Finish Application No. 20125146, filed Feb. 10, 2012, all of which are incorporated by reference in their entireties.

FIELD OF THE INVENTION

The invention relates to methods for the manufacture of nanofibrillated cellulose, particularly to pretreating of cellulose pulp in the manufacture of nanofibrillated cellulose, and to a nanofibrillated cellulose product obtainable by the method.

BACKGROUND

Nanofibrillated cellulose (NFC) is typically obtained by mechanical disintegration of cellulose pulp, carried out with suitable disintegration equipment. Mechanical disintegration is an energy consuming operation where the production capacity is limited. Thus several measures have been proposed for improving the grinding or fibrillation process, such as modification of pulp prior to the disintegration. Said modification may comprise chemical modification of the pulp to yield anionically or cationically charged grades of nanofibrillated cellulose (NFC). Said chemical modification may be based for example on carboxymethylation, oxidation, esterification, or etherification of cellulose molecules. However, said chemical modification methods result in grades of NFC, which are not desirable for all applications and thus also alternative methods have been studied, such as pregrinding, carboxymethylcellulose adsorption and enzymatic treatment.

Accordingly, there exists a need to provide improved methods for the pretreatment of pulp in the manufacture of NFC and improved methods for the manufacture of NFC.

SUMMARY

The present invention is based on studies on pretreating of cellulose pulp prior to mechanical disintegration. It was found that mechanical disintegration, particularly fibrillation can be enhanced and a NFC product with improved properties can be obtained.

The method for pretreating of cellulose pulp comprises the steps where an aqueous suspension of native cellulose pulp is brought into contact with an inorganic or organic acid and agitated to obtain pH of the suspension below 4, followed by removal of water and washing the solid matter with water, forming an aqueous suspension of the solid matter, then at least one water soluble salt of $NH_4^+$, alkali metal, alkaline earth metal or metal is added to the formed suspension followed by agitation, the pH of suspension is adjusted to more than 7 using an inorganic base, followed by removal of water, and washing the solid matter with distilled or deionized water.

The method for the manufacture of nanofibrillated cellulose comprises the steps where native cellulose pulp is pretreated, said pretreating comprising the steps where an aqueous suspension of native cellulose pulp is brought into contact with an inorganic or organic acid and agitated to obtain pH of the suspension below 4, followed by removal of water and washing the solid matter with water, forming an aqueous suspension of the solid matter, then at least one water soluble salt of $NH_4^+$, alkali metal, alkaline earth metal or metal is added to the formed suspension followed by agitation, the pH of suspension is adjusted to more than 7 using an inorganic base, followed by removal of water, and washing the solid matter with distilled or deionized water, forming an aqueous suspension of the solid matter and disintegrating the solid matter.

A NFC product is obtainable with the method, said product having turbidity of less than 200 NTU and Brookfield viscosity more than 15 000 mPas (determination suitably with 1.5%, 10 rpm).

Accordingly, the present invention provides means for the manufacture of NFC with improved properties, in a more efficient and economical way.

The characteristic features of the invention are presented in the appended claims.

DEFINITIONS

Figure 1:
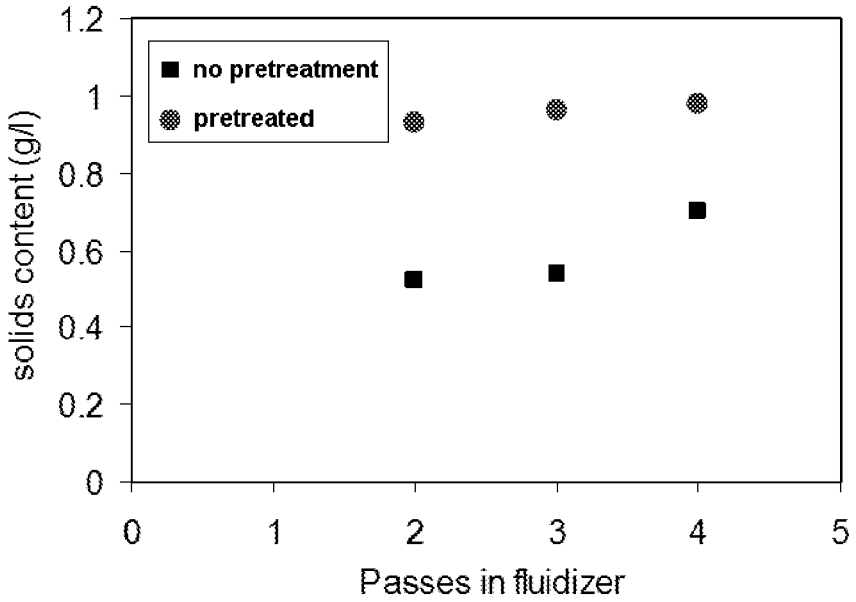
FIG. 1 illustrates the effect of pretreatment of cellulose pulp before disintegration on the amount of nanomaterial in the NFC product.

Unless otherwise specified, the terms, which are used in the specification and claims, have the meanings commonly used in the field of pulp and paper industry. Specifically, the following terms have the meanings indicated below.

As used herein, the term "nanofibrillated cellulose" or NFC is understood to encompass all microfibrillated celluloses (MFC) and fibril celluloses. Further, there are several other widely used synonyms for nanofibrillated cellulose. For example: cellulose nanofiber, nanofibril cellulose (CNF), nanofibrillar cellulose (NFC), nano-scale fibrillated cellulose, microfibrillar cellulose, or cellulose microfibrils.

Mechanical disintegration means here any means for disintegration or fibrillation cellulose fibers to obtain NFC. Fibrillation may be carried out for example using a stone mill, refiner, grinder, homogenizer, colloider, supermass colloider, friction grinder, ultrasound-sonicator, fluidizer such as microfluidizer, macrofluidizer or fluidizer-type homogenizer.

The term "native cellulose pulp" refers here to any cellulose pulp, which has not been chemically modified.

The term "suspension" refers here to a heterogeneous fluid containing solid particles and it encompasses also slurries and dispersions, typically in aqueous liquid.

DETAILED DESCRIPTION OF THE INVENTION

It was surprisingly found that mechanical disintegration of cellulose pulp can be improved, whereby higher yields of the desired nanofibrillated product can be obtained with less energy. Additionally the properties of the final NCF product are simultaneously improved.

Accordingly, cellulose pulp is pretreated with acid and base prior to the mechanical disintegration. The pretreatment is effected by subjecting the cellulose pulp to mild acid treatment for removing positively charged ions, followed by treatment with a base containing defined, positively charged ions, for replacing the earlier ions. The pretreated cellulose pulp is subsequently disintegrated. The pretreatment provides the final product with excellent gelling properties and transparency.

The method for pretreating of cellulose pulp comprises the steps where an aqueous suspension of native cellulose pulp is brought into contact with an inorganic or organic acid and agitated to obtain pH of the suspension below 4, followed by removal of water and washing the solid matter with water, and forming an aqueous suspension of the solid matter, then at least one water soluble salt of $NH_4^+$, alkali metal, alkaline earth metal or metal is added to the formed suspension followed by agitation, the pH of suspension is adjusted to more than 7 using an inorganic base, followed by removal of water, and washing the solid matter with distilled or deionized water.

The method for manufacture of nanofibrillated cellulose comprises the steps where native cellulose pulp is pretreated, said pretreating comprising the steps where an aqueous suspension of native cellulose pulp is brought into contact with an inorganic or organic acid and agitated to obtain pH of the suspension below 4, followed by removal of water and washing the solid matter with water, and forming an aqueous suspension of the solid matter, then at least one water soluble salt of $NH_4^+$, alkali metal, alkaline earth metal or metal is added to the formed suspension followed by agitation, the pH of suspension is adjusted to more than 7 using an inorganic base, followed by removal of water, and washing the solid matter with distilled or deionized water, forming an aqueous suspension of the solid matter and disintegrating the solid matter.

In said methods the water soluble salt of $NH_4^+$, alkali metal, alkaline earth metal or metal is suitably used in an amount to obtain a concentration of 0.001 to 0.01 M (0.1 to 1 mol/kg fiber or solid material), particularly of 0.002 to 0.008 M.

In the pretreating method the content of solid matter in the suspension may range from 0.1 to 20% by weight, suitably from 0.5 to 3% by weight.

The inorganic or organic acid is suitably an acid, which can be easily washed away, leaves no undesirable residues in the product and has a pKa-value between −7 and 7.

The organic acid may be selected from short chain carboxylic acids, such as acetic acid, formic acid, butyric acid, propionic acid, oxalic acid and lactic acid. Short chain carboxylic acid refers here to C1-C8 acids. The inorganic acid may suitably be selected from hydrochloric acid, nitric acid, hydrobromic acid and sulphuric acid.

Suitably the acid is used as a dilute, from 0.001 to 5 M aqueous solution, which can be conveniently added to the suspension. Suitably the addition time of the acid is between 0.2 to 24 hours.

The pH is adjusted using the acid to below 4, suitably to below 3.

Water used in the method may be tap water, distilled water, deionized water, purified water or sterilized water. Suitably distilled water or deionized water is used, particularly in the washing step following the pH adjustment to more than 7.

Water removal from the suspension or slurry may be carried out by any suitable means, for example with web press, pressure filtering, suction filtering, centrifuging and screw press.

The solid matter may be washed 1-5 times, suitably 2-3 times with water after acid treatment to remove excess acid.

Washing of solid matter with water may suitably be carried out after the water removal steps using the same equipment.

The water soluble salt of $NH_4^+$, alkali metal, alkaline earth metal or metal, may be selected from inorganic salts, complexes and salts formed with organic acids, of $NH_4^+$, alkali metal, alkaline earth metal or metals, suitably of $NH_4^+$, Na, K, Li, Ag and Cu. The inorganic salt is suitably sulphate, nitrate, carbonate or bicarbonate salt, such as $NaHCO_3$, $KNO_3$ or $AgNO_3$. M refers to alkali metal, alkaline earth metal or metal. According to one suitable embodiment the water soluble salt is sodium salt.

The inorganic base is selected from NaOH, KOH, LiOH and $NH_3$.

The pH of the suspension is adjusted with the inorganic base to more than 7, suitably from 7.5 to 12, particularly suitably from 8 to 9.

After the pH adjustment with the inorganic base, the water removal is carried out and the solid matter is washed with distilled or deionized water. Suitably the washing is repeated or carried out until the conductivity of the used washing liquid, such as filtrate, is less than 200 μS/cm, suitably less than 100 μS/cm, particularly suitably less than 20 μS/cm.

After the addition of components (acid, salt, base) to the suspensions the formed mixtures may be agitated and allowed to stand before continuing the method.

The obtained pretreated solid matter, suitably as an aqueous suspension, is mechanically disintegrated in a disintegrator to obtain the nanofibrillated cellulose product. Suitably the disintegrator is selected from a stone mill, ball mill, refiner, grinder, homogenizer, high pressure homogenizer, colloider, supermass colloider, friction grinder, ultrasound-sonicator, fluidizer, microfluidizer, macrofluidizer, high pressure fluidizer, ultrahigh pressure fluidizer or fluidizer-type homogenizer.

Optionally the pretreated solid matter may be preground prior to the mechanical disintegration. Any standard grinders or mills can be used. If a fluidizer type disintegrator is used for the mechanical disintegration it is particularly suitable to pregrind the pretreated solid matter. Pregrinding may be carried out using any suitable grinding apparatus.

The mechanical disintegration is suitably carried out from 1 to 10 passes, particularly suitably from 1 to 5 passes.

A NFC product is obtainable by the method, said NFC product comprising mechanically disintegrated native cellulose, having turbidity of less than 200 NTU, even less than 150 NTU. Said product may have Brookfield viscosity more than 15 000 mPas, suitably more than 30 000 mPas, particularly suitably more than 40 000 mPas (1.5%, 10 rpm).

The apparent viscosity of NFC is suitably measured with a Brookfield viscosimeter (Brookfield viscosity) or another corresponding apparatus. Suitably a vane spindle (number 73) is used. There are several commercial Brookfield viscosimeters available for measuring apparent viscosity, which all are based on the same principle. Suitably RVDV spring (Brookfield RVDV-III) is used in the apparatus. As a result, a viscosity graph is obtained with varying shear rate. A low rotational speed is suitable, such as 10 rpm. In the Brookfield viscosity method, the NFC sample is diluted in a liquid, suitably water, with agitation to a concentration ranging between 0.1 and 2.0% by weight, (in the examples 1.5%).

The turbidity may be measured quantitatively using optical turbidity measuring instruments, which work on two different physical principles: measurement of attenuation of the intensity of a light beam passing through the liquid (turbidimetry) and measurement of the intensity of scattered radiation (light) (nephelometry). The scattering is caused by the particles. Turbidity may also be determined by reflectometry. There are several commercial turbidometers available for measuring quantitatively turbidity. In the present case the method based on nephelometry is used. The units of turbidity from a calibrated nephelometer are called Nephelometric Turbidity Units (NTU).

The measuring apparatus (turbidometer) is typically calibrated and controlled with standard calibration samples, followed by measuring of the turbidity of the diluted NFC sample.

In the method, a fibril cellulose sample is diluted with a liquid, preferably an aqueous medium, such as water, to a concentration below the gel point of said fibril cellulose, and turbidity of the diluted sample is measured. Suitably, said concentration may range between 0.001 and 1% by weight, suitably from 0.1 to 1%, and the turbidity is measured. The mean value and standard deviation are calculated from the obtained results, and the final result is given as NTU units.

Analysis of fibers may be carried out by a method based on accurate high resolution microscopy and image analysis, which is suitable for the quantitative determination of micro- and nanoscale fibers of NFC whereby the unfibrillated fiber-like material is determined in the fibril cellulose. The amount of detectable fibers or fiber-like particles within a known amount of pulp sample is measured and the rest of the sample is then regarded as belonging into the non-detectable category, i.e. micro- and nanoscale particles. Commercial fiber analyzers can be used for characterizing the unfibrillated fiber-like material in fibril cellulose. For example, Kajaani Fiberlab and FS-300 devices are suitable. However, other similar fiber analyzers with similar detection resolution can be also used.

The fiber analysis comprises the steps, where the dry mass of the sample is determined for use in the analysis, followed by volumetric scaling during dilution and sampling, disintegration of the sample. A greater sample size than with conventional pulp samples may be used if necessary. The sample size for the measurements may be increased from the recommended one in order to increase the amount of detected fibers during the analysis.

For simplicity a quantitative measure of particles per milligram is used.

The amount of the nanomaterial in the upper phase as described in FIG. 1, was determined by weighing in 50 ml tubes 1.6 g/L solids of a wet sample, followed by centrifuging 2 hours at 20° C. temperature. After centrifuging the sample was dried and weighed and the amount of the nanomaterial of the upper phase was calculated. The more the sample was fibrillated, the bigger amount of nanomaterial was found in the upper phase. This can be seen in FIG. 2, where the pretreated product contained almost twice the amount of nanomaterial when compared to the one without pretreatment.

Any native cellulose pulp from any plant origin, obtained from any plant based cellulose raw material may be used in the method.

The term "cellulose raw material" refers to any plant based cellulose raw material (plant material) source that contains cellulose and that can be used in production of cellulose pulp, refined pulp, and fibril cellulose.

Plant material may be wood and said wood can be from softwood tree such as spruce, pine, fir, larch, douglas-fir or hemlock, or from hardwood tree such as birch, aspen, poplar, alder, eucalyptus or acacia, or from a mixture of softwoods and hardwoods. Non-wood material can be from agricultural residues, grasses or other plant substances such as straw, leaves, bark, seeds, hulls, flowers, vegetables or fruits from cotton, corn, wheat, oat, rye, barley, rice, flax, hemp, manilla hemp, sisal hemp, jute, ramie, kenaf, bagasse, bamboo or reed.

The term "cellulose pulp" refers to cellulose fibers, which are isolated from any cellulose raw material using chemical, mechanical, thermo-mechanical, or chemi-thermo-mechanical pulping processes.

Cellulose pulp of plant origin, especially wood (softwood or hardwood pulp, for example bleached birch pulp) and where the cellulose molecules are produced in one of the above-described methods, is easy to disintegrate to fibril cellulose using any mechanical disintegration methods.

The term "nanofibrillated cellulose" or NFC refers to a collection of isolated cellulose microfibrils (nanofibers) or microfibril bundles derived from cellulose raw material. Microfibrils have typically high aspect ratio: the length exceeds one micrometer while the number-average diameter is typically below 200 nm (1-200 nm, suitably 1-100 nm). The diameter of microfibril bundles can also be larger but generally less than 1 μm. The smallest microfibrils are similar to so called elementary fibrils, which are typically 2-12 nm in diameter. The dimensions of the fibrils or fibril bundles are dependent on raw material and disintegration method.

NFC is characterized by very high water retention values, a high degree of chemical accessibility and the ability to form stable gels in water or other polar solvents. NFC product is typically a dense network of highly fibrillated celluloses. NFC may also contain some hemicelluloses; the amount is dependent on the plant source and pulping conditions.

Several different grades of NFC have been developed using various production techniques. The grades have different properties depending on the manufacturing method, degree of fibrillation and chemical composition. The chemical compositions of the grades also vary. Depending on the raw material source, e.g. HW vs. SW pulp, different polysaccharide composition exists in the final NFC product.

NFC may be sterilized prior to use, suitably in a gel form. In addition, if desired, prior to fibrillation/mechanical disintegration, the cellulose pulp may be aseptically collected from the pulp mill immediately after bleaching stage when the pulp is still sterile.

The obtained NFC has excellent gelling ability, which means that it forms a hydrogel already at a low consistency in an aqueous medium.

The pretreatment results typically in $M^+$ form of native cellulose pulp. M is alkali metal, alkaline earth metal or metal, suitably Na, K, Li, Cu or Ag, particularly Na The obtained $M^+$ form of native cellulose pulp provides benefits to the NFC manufactured there from, particularly with respect to the fibrillation process and quality of the obtained nanofibrillated cellulose product. Particularly, an improved quality of native NFC, simultaneously with respect to transparency and viscosity can be achieved, when compared to a similar NFC manufactured without the pretreatment step, even if the fibrillation energy was increased unlimitedly, for example increasing the number of passes in the mechanical disintegrator.

The pretreated NFC product is also suitable for biochemical, pharmaceutical and molecular science applications because the product contains no reagent residues like for example the chemically modified grades of NFC, it is biocompatible and compatible with various components. Said residues are regarded as potentially toxic or harmful in drug delivery applications, in applications dealing with highly sensitive analysis and determination of biochemical compounds. As NFC is not a polymerization product, there are no monomer residues left in the product. With regard to nucleic acid analysis and isolation, the risk of potential enumeration and detection problems can be avoided or at least significantly reduced. It has no adverse effects and does not interfere with DNA isolation or PCR analysis.

The pretreated NFC is a nontoxic product, which is easy to manufacture, easy to handle and requires no specific precautions from the end user.

When compared with the untreated product, the pretreated NFC product offers at least the following benefits:

- Fibrillated $M^+$ form of native cellulose pulp contains higher amounts of nanomaterial
- The amount of finer material is higher and the NFC material is more homogeneous
- A product having turbidity of less than 200 NTU, even less than 150 NTU can be achieved with pretreated NFC
- Higher viscosities can be achieved with fibrillated $Na^+$ form of cellulose pulp, the viscosity being more than 15 000 mPas, suitably more than 30 000 mPas (1.5%, 10 rpm)
- Neutral, highly transparent and highly viscous product can be obtained without chemical pretreatment or without additives
- The gellability of the NFC product is improved
- According to fiber analysis (Fiberlab test) the pretreated NFC product contains less than 5000 particles/mg, suitably less than 1000 particles/mg (large particles), even less than 200 particles/mg.
- The purity of the NFC product is high (contains less impurities and contains no salts), and the quality is reproducible.
- The method provides a NFC product of higher quality with the same or even lower energy input

EXAMPLES

The following examples are illustrative embodiments of the present invention as described above, and they are not meant to limit the invention in any way.

Example 1: Pretreatment of Cellulose Pulp Followed by Fibrillation 1500 g of wet native cellulose pulp obtained from bleached birch pulp was filtered and the solid mass was diluted with 0.01 M aqueous HCl to obtain suspension having dry matter content of approx. 1-1.2% by weight. The suspension was allowed to stand for approx. 15 min with occasional agitation. The suspension was then filtered, washed twice with deionized water and filtered. Then the solid mass was suspended in a 0.005 M aqueous $NaHCO_3$ solution to obtain suspension having dry matter content of approx. 1-1.2% by weight, the pH of the obtained suspension was adjusted between 8 and 9 with 1 M aqueous NaOH solution and the obtained suspension was allowed to stand for 15 min with occasional agitation. The suspension was filtered and the solid mass was washed with deionized water until the conductivity of the filtrate was less than 20 μS/cm.

Samples of the obtained solid mass were fibrillated (mechanically disintegrated) from 1 to 5 passes using Masuko Supermass colloider, with MKGA10-80 grinding stones. Respectively also samples without the pretreatment were subjected to fibrillation in the Masuko Supermass colloider, with MKGA10-80 grinding stones.

Samples of the obtained solid mass were also preground, followed by fibrillation in Microfluidics Fluidizer, once through APM+200 μm chambers and from 1 to 10 times through APM+100 μm chambers. Samples from pretreated and after 2, 3 and 4 passes and without pretreatment were centrifuged and the amount of the nanomaterial (nanosized material) in the upper phase was determined.

Results presented in FIG. 1 show that the pretreated material (Fluidizer Na) contains more nanomaterial after pregrinding and fluidization. According to testing it contained 59% by weight of nanosized material and the untreated sample (Fluidizer ref.) contained 35% by weight of nanosized material.

Figure 2:
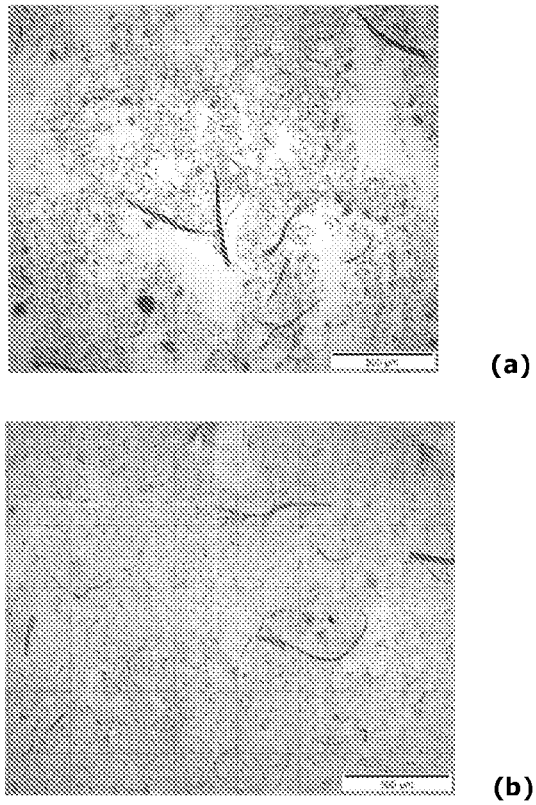
FIG. 2 presents microscope photos of fibrillated cellulose products without pretreatment (a) and pretreated NFC (b).

FIG. 2 illustrates the difference between the fibrillation in the pretreated (2*b*) and untreated (2*a*) material after fibrillation (4 passes), as optical microscope photos.

Figure 3:
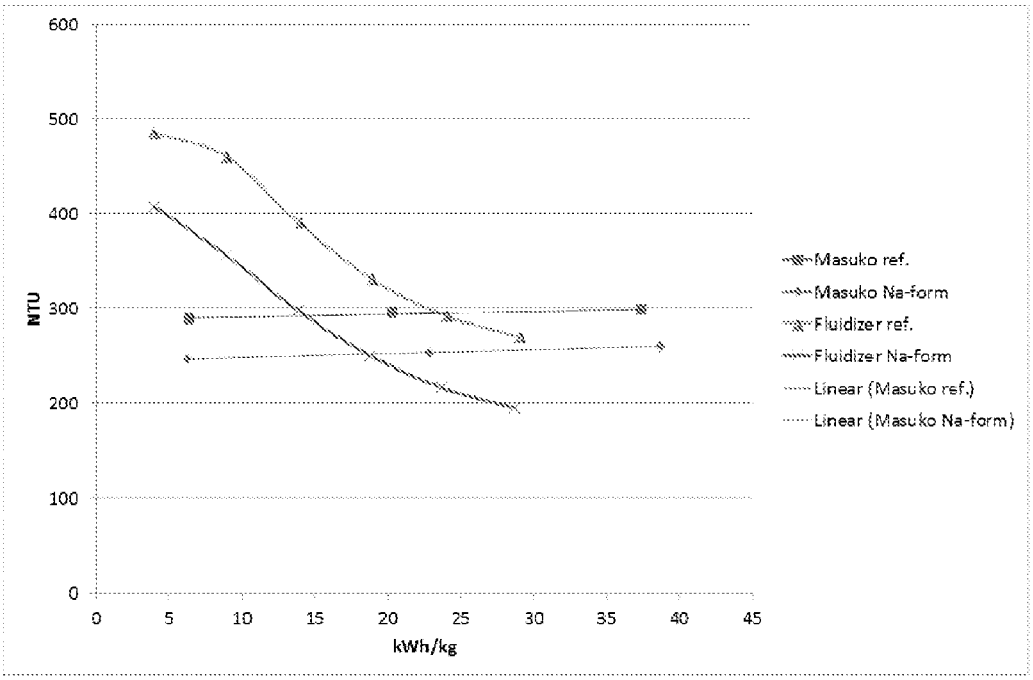
FIG. 3 illustrates graphically the turbidity of NFC samples as a function of energy consumption in fibrillation.

FIG. 3 provides turbidity results as a function of energy consumption, of pretreated samples and untreated samples after fibrillation in a supermass colloider (Masuko) or a Fluidizer. Without the pretreatment no product with turbidity below 200 was obtained. Pretreatment clearly reduces the turbidity values. Turbidity was measured using an optical method, wherein so called turbidimetry and nephelometry are used. The measurement was carried out at 0.1% concentration using HACH P2100-device. A NFC sample was diluted with water in such a way that 299.5 g water and 0.5 g NFC (calculated as NFC) are mixed carefully.

Figure 4:
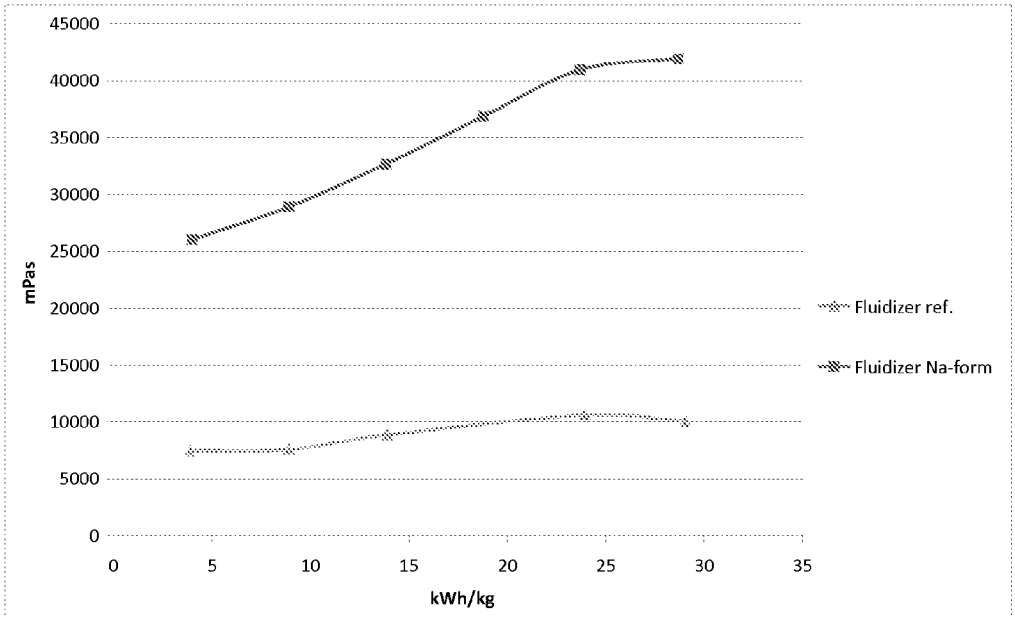
FIG. 4 illustrates graphically the viscosity of NFC samples as a function of energy consumption in fibrillation.

Results of Brookfield viscosity measurements of pretreated fibrillated products and untreated fibrillated products (fibrillation in Microfluidics Fluidizer) are presented in FIG. 4. Higher viscosities are obtained with pretreated samples. Brookfield viscosimeter with a vane spindle number 73 was used, equipped with Brookfield RVDV-III spring, rotational speed 10 rpm and 1.5% concentration. According to fiber analysis (Fiberlab Kajaani apparatus) pretreated fibrillated product (fibrillation in Microfluidics Fluidizer) 3 passes, comprised 9410 particles/g and 6 passes, comprised 86 particles/g. The corresponding untreated product, 3 passes, comprised 14029 particles/g and 6 passes 692 particles/g.

Respectively, Brookfield viscosities of pretreated fibrillated products and untreated fibrillated products (fibrillation with Masuko Supermass colloider) 2 passes, were 67329 mPas and 44763 mPas.

While the invention has been described with respect to specific examples including presently preferred modes of carrying out the invention, those skilled in the art will appreciate that there are numerous variations and permutations of the above described embodiments that fall within the spirit and scope of the invention. It should be understood that the invention is not limited in its application to the details of construction and arrangements of the components set forth herein. Variations and modifications of the foregoing are within the scope of the present invention.

The invention claimed is:

1. A nanofibrillated cellulose product obtainable by the method comprising:

pretreating native cellulose pulp, the pretreating comprising bringing an aqueous suspension of the native cellulose pulp into contact with an inorganic or organic acid, agitating the aqueous suspension of native cellulose pulp and inorganic or organic acid to obtain a pH below about 4, removing water from the aqueous suspension of native cellulose pulp and inorganic or organic acid to obtain solid matter, washing the solid matter with water, thereby forming an aqueous suspension of the solid matter, adding at least one water soluble salt of NH4+, alkali metal or alkaline earth metal or metal to the aqueous suspension of the solid matter, agitating the aqueous suspension of the solid matter, adjusting the pH of the aqueous suspension of the solid matter to about 7.5 to about 12 using an inorganic base, removing water to yield solid matter of the aqueous suspension of the solid matter, and washing the solid matter of the aqueous suspension of the solid matter with distilled or deionized water to yield pretreated native cellulose pulp;

forming an aqueous suspension of the pretreated native cellulose pulp; and disintegrating the aqueous suspension of native cellulose pulp mechanically via more than one pass through a mechanical disintegration device, wherein the product includes native cellulose and has a turbidity of less than about 200 NTU at about 0.1% concentration and a Brookfield viscosity of more than about 15,000 mPas at about 1.5% concentration.

2. The nanofibrillated cellulose product of claim 1, wherein the product has a turbidity of less than about 150 NTU at about 0.1% concentration.

3. The nanofibrillated cellulose product of claim 1, wherein the product has Brookfield viscosity of more than about 30,000 mPas at about 1.5% concentration.

4. The nanofibrillated cellulose product of claim 1, wherein the product has gelling properties.

5. The nanofibrillated cellulose product of claim 1, wherein the product includes less than about 5,000 particles.

6. The nanofibrillated cellulose product of claim 1, wherein the product is substantially free of salts.

7. The nanofibrillated cellulose product of claim 1, wherein the product includes fewer impurities than the native cellulose pulp.

8. The nanofibrillated cellulose product of claim 1, wherein the more than one pass is between two and ten passes.

9. The nanofibrillated cellulose product of claim 1, wherein the product is generally transparent.

10. The nanofibrillated cellulose product of claim 1, wherein the pretreated native cellulose pulp is in M+ form of native cellulose pulp, wherein M is an alkali metal, an alkaline earth metal, or a metal.

11. The nanofibrillated cellulose product of claim 10, wherein the pretreated native cellulose pulp is a metal, wherein the metal is Na, K, Li, Cu, or Ag.

* * * * *